United States Patent [19]

MacAskill, Jr. et al.

[11] 4,222,089

[45] Sep. 9, 1980

[54] OIL BURNER IGNITION AND CONTROL PACKAGE

[75] Inventors: Robert B. MacAskill, Jr., Bay Village; Archie R. Cornell, Avon Lake, both of Ohio

[73] Assignee: The Scott & Fetzer Company, Westlake, Ohio

[21] Appl. No.: 850,428

[22] Filed: Nov. 10, 1977

[51] Int. Cl.[2] ..... F23Q 3/00

[52] U.S. Cl. ..... 361/263; 361/331; 361/380; 361/399; 431/263

[58] Field of Search ..... 361/263, 388, 389, 380, 361/392, 399, 427, 331, 334; 431/142, 263, 79; 336/65, 67, 107, 184, 192, 212, 216, 217, 92

[56] References Cited

U.S. PATENT DOCUMENTS

| | | | |
|---|---|---|---|
| 1,598,486 | 8/1926 | Mallory | 336/184 |
| 2,068,522 | 1/1937 | Thordarson | 336/67 |
| 2,904,763 | 9/1959 | Harruff | 336/184 |
| 3,117,619 | 1/1964 | Lange et al. | 431/263 |
| 3,260,299 | 7/1966 | Lister | 361/263 |
| 3,321,168 | 5/1967 | D'Entremont | 336/65 |
| 3,582,714 | 6/1971 | Shmurak et al. | 361/389 |
| 3,793,129 | 2/1974 | Doggart et al. | 336/216 |
| 3,902,854 | 9/1975 | Brown | 361/263 |
| 3,947,219 | 3/1976 | Santo | 431/79 |
| 3,949,338 | 4/1976 | Burson | 336/107 |
| 4,039,900 | 8/1977 | Roback et al. | 361/388 |

FOREIGN PATENT DOCUMENTS 755250 5/1943 Fed. Rep. of Germany ..... 336/184

OTHER PUBLICATIONS

M. W. Sims, #712,661, Induction Apparatus, 5/23/1950.

*Primary Examiner*—B. A. Reynolds
*Assistant Examiner*—Clifford C. Shaw
*Attorney, Agent, or Firm*—Pearne, Gordon, Sessions

[57] ABSTRACT

The high voltage transformer for the ignition system of an oil burner and the control system for the oil burner are packaged together in a single housing. The duty cycle of the transformer is discontinuous. The transformer core is of symmetric U-I configuration but the coil arrangement is asymmetric with a single primary coil being provided. The transformer is not potted, the core ends are free of coils, and one core end overlaps a circuit board for the control system to thereby foreshorten the overall package. Although the transformer is not potted, tight constraints against shorting of the high voltage secondary leads are maintained by provision of an insulator bushing means which is positioned in apposition to the transformer secondary coils by means of a bracket which also provides a mounting for the transformer core, the high voltage leads being drawn through the insulator bushing means and secured at terminal contacts at the lower ends of the bushing means. The entire package is hinged for movement into and out of working association with the ignition leads of an oil burner.

8 Claims, 8 Drawing Figures

OIL BURNER IGNITION AND CONTROL PACKAGE

This invention relates to oil burner ignition and control apparatus and particularly to the combining of the high voltage transformer for the ignition system of an oil burner and the control system for the oil burner in a single package of novel design.

Such elements are conventionally packaged separately because combined packages have heretofore been too bulky and unwieldy. The transformers for such systems, which commonly employ cores of bilaterally symmetric U-I configuration, have generally been required to be potted in order to meet stringent Underwriters Laboratories requirements with respect to spacing of high voltage leads. Potting contributes greatly to bulk, weight and manufacturing cost. It has also been common practice to provide a primary winding or coil at one end of the core where a single coil can be positioned while maintaining bilateral symmetry of coil arrangement. This has further contributed to bulkiness of prior art transformers and to the impracticality of a combined package.

By departing from these practices of the prior art, the present invention provides a combined package for the transformer for high voltage oil burner ignition and the control system for the oil burner. The transformer is not potted, the core ends are free of coils, and one core end overlaps a circuit board for the control system on both sides of which circuit elements are supported. Although the transfomer is not potted, tight constraints against shorting of the high voltage secondary leads are maintained by provision of insulator bushing means which are positioned in apposition to the transformer secondary coils by means of a bracket which also serves as a mounting for the transformer core. The high voltage leads are drawn through the insulator bushing means and are secured at terminal contacts at the lower end of the bushing means. The entire package is hinged for movement into and out of working association with the ignition leads of the oil burner.

Regardless of the specific location of particular coils on the core, prior art ignition transformers have generally provided a bilaterally symmetric arrangement of the coils on the bilaterally symmetric core in order to avoid the magnetic flux aberrations and attendant heating associated with asymmetric arrangements of coils on the symmetric core. According to the present invention, further economy can be realized by arranging a single primary coil on the core in an asymmetric manner, with provision for discontinuous duty cycle operation of the transformer The result of the foregoing departures from the prior art are economical and convenient combined ignition transformer and control systems which can be provided as single units which oil furnace manufacturers can include as OEM equipment with their product. The manufacturer, the installer, the consumer, and the servicer are offered the advantages of reduced manufacturing cost, reduced overall weight and size, greater ease of assembly and increased modularity.

DESCRIPTION OF THE ILLUSTRATED EMBODIMENT

Figure 1:
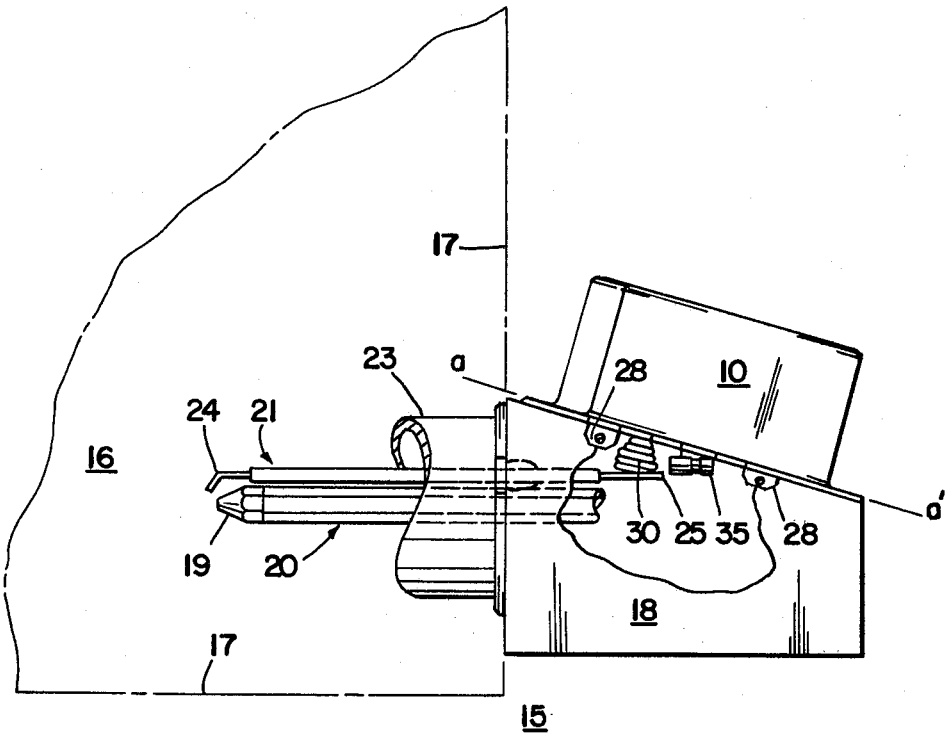
FIG. 1 is a side view of a transformer-control package embodying the invention mounted on an oil burner schematically represented with portions cut away.
Figure 2:
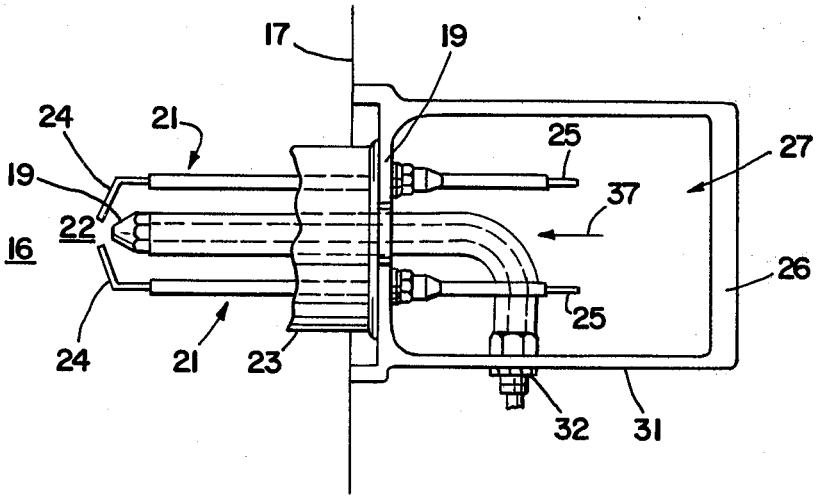
FIG. 2 is a top view of FIG. 1 with the transformer-control package removed.

An oil burner ignition and control package 10 in accordance with the present invention is mounted on an oil burner 15 as illustrated by FIG. 1. Referring to FIGS. 1 and 2, the oil burner includes a combustion chamber 16 defined by walls 17, one of the walls 17 supporting a high voltage box 18 exterior to the combustion chamber 16.

Extending from the interior of the high voltage box 18 to a spark gap area 22 within the combustion chamber 16, are an oil nozzle assembly 20 and an adjacent pair of electrically insulated high voltage electrodes 21.

Atomized fuel oil or the like provided at the spark gap 22 via an oil nozzle 19 is initially ignited by a high voltage arc generated across the spark gap area 22 by electrically uninsulated distal ends 24 of the electrodes 21. A thermal protection sleeve 23 extends about portions of the fuel nozzle assembly 20 and electrodes 21 within the combustion chamber 16.

Under operating conditions, the ignition and control package 10 rests against an upper support flange 26 perimetrically extending about an open top 27 of the high voltage box 18.

The package 10 is fastened to the high voltage box by two double leaf hinges 28 which provide limited counterclockwise rotation of the package 10 about the axis of rotation a—a′ so as to permit ready access to the high voltage box interior for maintenance purposes.

Electrically uninsulated ends 25 of the high voltage electrodes are electrically connected to the control package 10 via a pair of spring-like contacts 30 (FIG. 4) extending between the control package 10 and the electrodes 21 as illustrated in FIG. 1. The spring-like contacts 30 are sized so as to be partially compressed between the electrodes ends 25 and the control package 10 so as to ensure good electrical continuity.

Mounted to the underside of the ignition and control package 10 is a flame detector 35 (FIG.4) of, for example, the cadmium sulphide type well known in the art. The flame detector 35 is arranged so as to look between the spring-like contacts 30 into the combustion chamber 16 via an aperture 36 (FIG. 2) provided in a front wall 19 of the high voltage box 18 as indicated by arrow 37. The front wall 19 supports the high voltage electrodes 21 and a conduit portion 29 of the fuel nozzle assembly 20. A side wall 31 of the high voltage box 18 supports a fuel oil intake coupling 32 which is connected to a source (not shown) of fuel oil or the like.

The oil burner 15 and the arrangement of the ignition and control package 10 relative to the oil burner are well known in the art.

Figure 3:
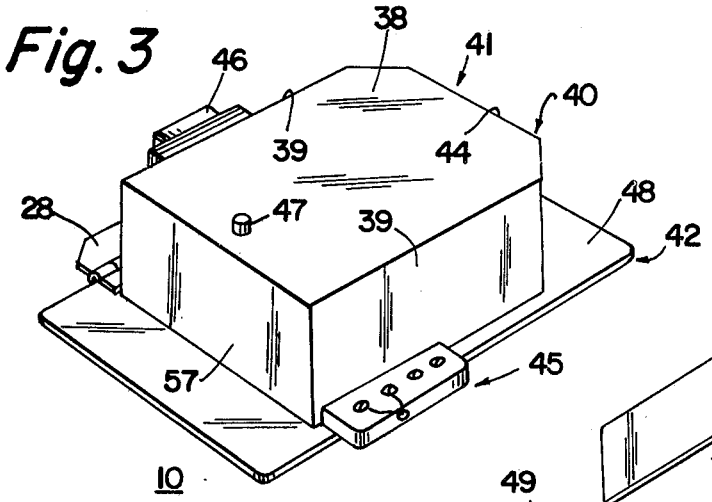
FIG. 3 is an isometric view taken from above of the transformer-control package.
Figure 4:
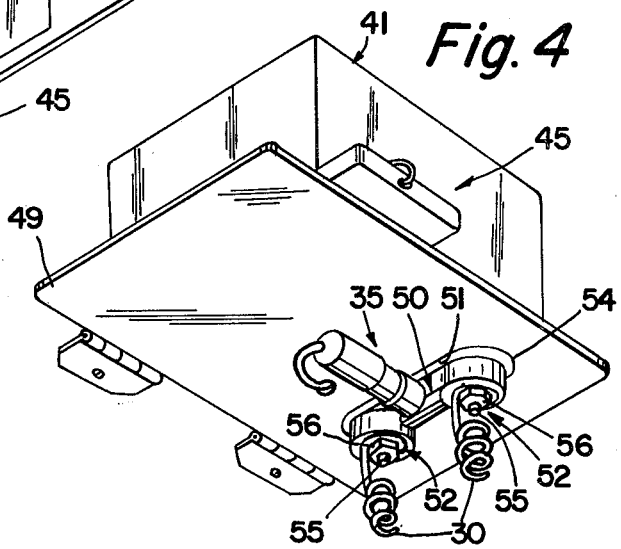
FIG. 4 is an isometric view of the same package taken from below.

Turning to FIGS. 3 and 4, the ignition and control package 10 includes a housing 40 having a sheet metal cover 41 and a base or mounting plate 42 having an upper surface 48 and a lower surface 49. The sheet metal cover has a top 38, two sides 39, and an end 44. All electrical components of the ignition and control package are advantageously contained within the housing 40 except an external circuit board terminal strip 45, a low voltage control transformer 46, and a circuit breaker reset button 47.

Extending from the undersurface 49 of the base plate 42 is a high voltage insulator 50 which extends from the interior of the housing 40 to a point below the base plate 42 via a first window-like aperture defined by a perimetric edge 51, the aperture having dimensions accommodating the insertion from above of the high voltage insulator 50, including the flange 54 thereof. The high voltage insulator 50, preferably in the form of a unitary glass-ceramic molding, includes a pair of terminal contacts 52 having threaded ends 55 to which are secured the pair of spring-like contacts 30 with suitable nuts 56.

Figure 5:
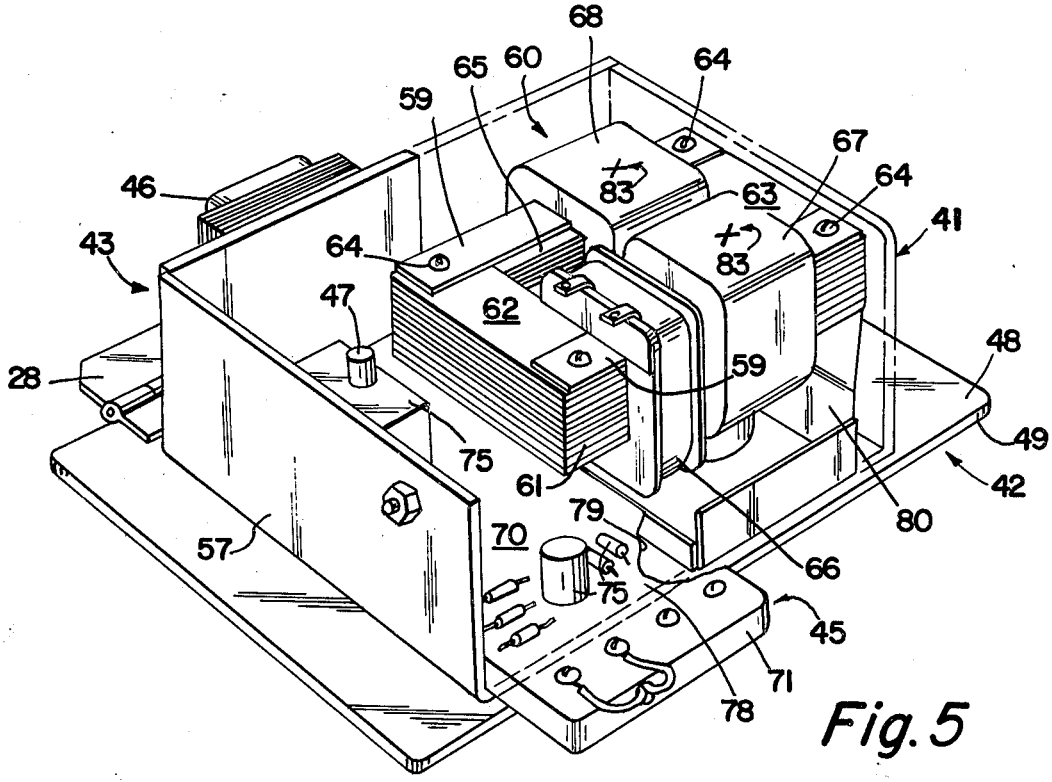
FIG. 5 is an isometric view taken from above of the transformer-control package with its cover shown in phontom.

Turning to FIG. 5, the interior of the housing 40 contains an unpotted high voltage ignition transformer 60 and a control circuit board 70 with an associated circuit breaker 75.

The control circuit board 70, circuit breaker 75, flame detector 35, low voltage control transformer 46 and associated wiring and a power semiconductor component (not shown) comprise an interrupted ignition burner control system of the type disclosed by U.S. Pat. No. 3,947,219, assigned to the assignee of the present invention. Such a control system is termed interrupted in that a high voltage ignition transformer, such as the transformer 60, associated with the burner control system, operates on a limited duty cycle wherein energization of the transformer is terminated when combustion within the chamber 16 is sensed by an associated flame detector, such as the flame detector 35. The control system interrupts the operation of the transformer 60 in intervals between ignitions of its associated oil burner 15.

The interior of the housing is defined by the upper surface of the base plate 48, the cover 41 and an L-shaped support wall 43 to which is mounted the control transformer 46 and a high-power semiconductor component (not shown) which utilizes the wall 43 as a heat sink. One end of the housing interior is associated with the end wall 44 (FIG. 3) of the cover 41, while the other end of the housing is defined by a leg 57 of the L-shaped support wall 43.

The transformer 60 includes a magnetic core of bilaterally symmetric U-I configuration formed of stacked laminations 61 of magnetic steel. Stacked U-shaped laminations form one end 62 of the core and two legs 65 thereof, the central portion of only one of the legs 65 being visible in FIG. 5, while stacked I-shaped laminations constitute the other end 63 of the core and close the open end of the U-shaped lamination stack. The laminations forming the core are fixed relative to each other in a conventional manner by suitable lamination fasteners 64 and connecting outer laminations 59 which extend the length of the core. The ends 62 and 63 of the transformer core are free of transformer coils. The legs 65 of the core are wrapped with transformer coils including a primary coil 66 and two high voltage secondary coils 67, 68. The secondary coils 67, 68 are side-by-side. The single primary coil extends along only a portion of one core leg 65 and is axially aligned with only one of the secondary coils with which it shares one of the core legs 65. While two side-by-side primary coils can be provided if desired, the illustrated and described bilaterally asymmetric primary coil arrangement, resulting from the provision of a primary coil on only one of the side legs 65, can be used with the interrupted ignition burner control system without undue heating due to magnetic flux aberrations. The added degree of heat associated with the asymmetry is dissipated during interruptions of transformer operations, and overall there is a net power savings compared with continuously operating systems, and a substantial manufacturing savings in the use of a single primary coil.

Figure 7:
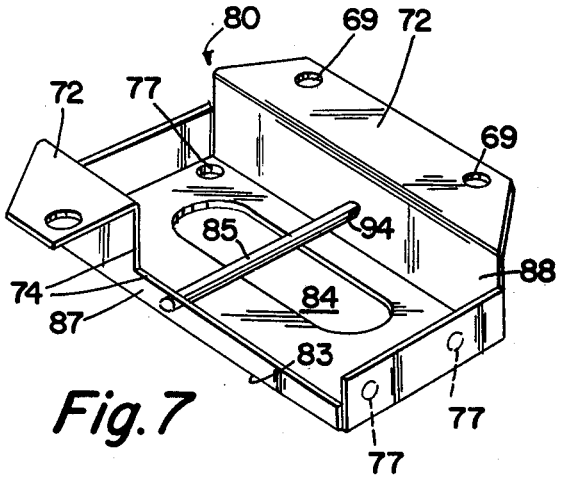
FIG. 7 is an isometric view of the transformer mounting bracket and an insulator tie-down pin.

The transformer 60 is supported by an understraddling bracket 80 and fastened to it by means of the lamination fasteners 64, which are received in the openings 69 (FIG. 7) which are formed on bracket flanges 72. The flanges 72 directly support the lowermost of the laminations 61 at either end of the core. A cut-out 74 on one side of the bracket accommodates the primary coil 66. The bracket 80 is supported by the base plate 42 to which it is fastened with appropriate screws (not shown) which may be punch-point screws or which may be received in holes 77 (FIG. 7) in the mounting bracket 80.

The control circuit board 70 (FIG. 5) has an upper circuit board surface 78 and a lower circuit board surface 79, both of which serve as mounting means for circuit elements 75. The lower circuit board surface 79 is spaced above the upper surface 48 of the support plate 42 by means of a spacer wall 71 extending circumferentially about and in contact with the edge of the circuit board.

The circuit board 70 and the transformer 60 extend from respective ends of the housing, associated with the support wall leg 57 and the cover end wall 44, to an intermediate housing location wherein one end 62 of the transformer core is spaced above and overlaps an end portion of the circuit board 70 to advantageously provide compactness which could not be achieved if the transformer were potted or if there were coils on the ends of the transformer core.

Figure 6:
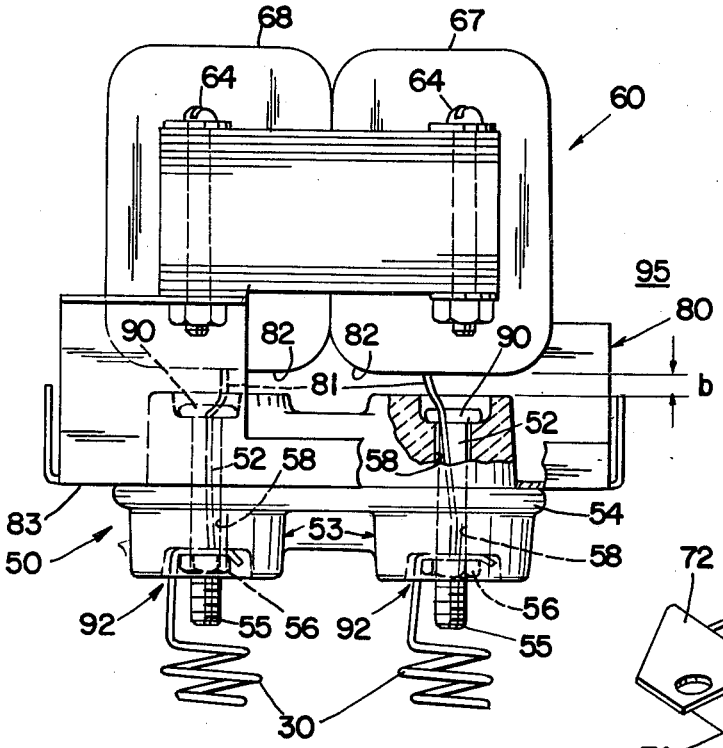
FIG. 6 is an end view of the preassembled high voltage transformer and tap means illustrated in FIG. 5 with portions cut away.

FIG. 6 illustrates a transformer preassembly 95 prior to its installation on the base plate 42. The preassembly includes the transformer 60 (shown with the primary coil removed) and combined mounting and high voltage tap means including the mounting bracket 80 and the high voltage insulator 50.

The secondary coils 67, 68 each have a high voltage terminal leads wire 81 extending from the undersides 82 of the secondary coils 67, 68. These terminal wires 81 extend from the undersides 82 of the secondary coils at terminal points axially and transversely centered. Such locations are illustrated by the "X" marks 83 (FIG. 5) on the top sides of the secondary coils 67, 68, the terminal wires 81 extending from corresponding locations on the undersides 82 of the secondary coils 67, 68.

Due to high voltages maintained on the terminal wires 81 during energization of the unpotted transformer 60, strict spacing requirements must be met in order to reduce the risk of short circuiting to an acceptable extremely low level. Such spacing requirements are met by the provision of the high voltage insulator 50 which includes a pair of spaced bushings 53 each having a centered bore or aperture 58 arranged in apposition to its respective terminal point on the underside of the secondary coils, the apertures 58 receiving terminal contacts 52 therethrough. The terminal wires 81 extend through the bushing apertures 58 and are held in place against the side walls of the apertures 58 by terminal contacts 52. The terminal wires 81 are further held in place by the clamping action of terminal contact heads 90 and mounted ends 92 of the spring contacts 30, the tightening of nuts 56 onto threaded end 52 serving as clamping forces. Before such clamping forces are applied, terminal wires 81 are pulled taut such that their exposed portions which bridge the narrow gap represented by length "b" (FIG. 6) are minimal.

Figure 8:
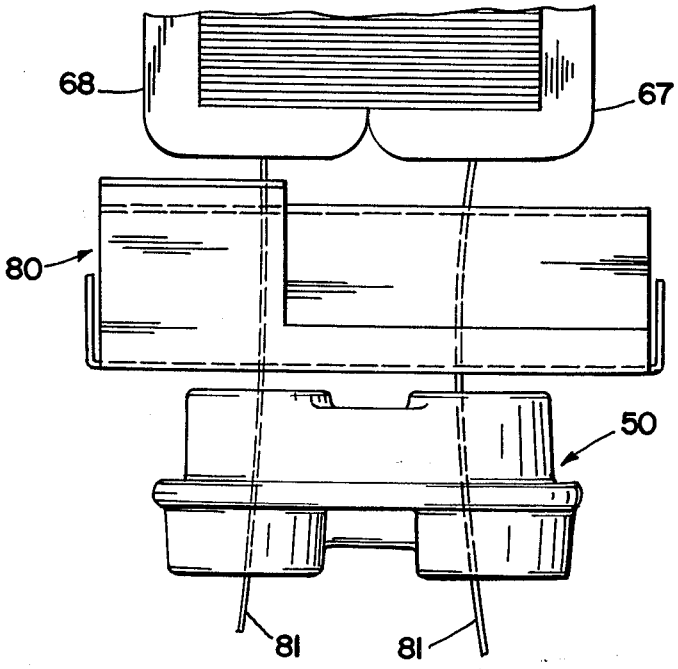
FIG. 8 is an exploded elevation view of the voltage tap means of the present invention.

FIG. 8 represents the prealignment of the transformer secondary windings 67, 68 the mounting bracket 80 and the insulator 50 with terminal wire 81 extending through the bushings 53. The elements shown in FIG. 8 are mated to one another to form the preassembly shown in FIG. 6 whereupon the excess lengths of the terminal wires 81 are trimmed. During this mating, the insulator 50 is inserted upwardly through a window-like aperture 84 (FIG. 7) in the base face 83 of the mounting bracket 80. The flange 54 serves as a detent and abuts the base face 83 of the bracket 80. A tie down peg or pin 85 (FIG. 7) is inserted through an aperture 94 in a bracket side wall 88 and a centered transverse insulator aperture 54 (FIG. 6), until the inserted end 86 of the tie down pin abuts an opposing side wall 87 of the mounting bracket 80.

The ignition transformer and control package of the present invention advantageously provides combined mounting and high voltage tap means associated with a high voltage ignition transformer, the tap means and transformer together providing a unitary non-potted assembly mountable as a unit on a windowed mounting base with high voltage terminal contacts projecting below the window of the base (window 51) for contact with ignition electrodes powered by the transformer.

The risk of high voltage short circuiting is minimized without potting by the provision of a unitary molding providing a pair of side by side insulator bushings extending from below the housing base plate and directly unwardly into apposition with high voltage transformer terminal points. Associated terminal wires are each drawn through the center of a respective one of the insulator bushings downwardly into anchoring contact with associated terminal contacts extending to points exterior of the housing base plate.

The scope of the invention is not necessarily limited to the specific details of the illustrated embodiment, but is defined by the following claims.

What is claimed is:

1. In a burner system having a combustion chamber, means for providing ignitable fuel and high voltage ignition electrodes in the chamber, the improvement comprising an unpotted mounted discontinuous duty cycle ignition transformer and tap means including a transformer core of U-I configuration, a pair of side-by-side secondary coils each wrapped around its associated one of the U-legs and extending along a portion of the length thereof, primary coil means extending along another length portion of the length of at least one of the U-legs, each secondary coil having a terminal wire leading from an axially and transversely central terminal point at the bottom side of the coil, a housing base plate spaced below said terminal points, high voltage bushing means formed as a unitary ceramic molding comprising a pair of side-by-side insulator bushings extending from below the housing base plate through the base plate and directly upwardly from the base plate into apposition with said terminal points, said terminal wires each being drawn through the center of its own bushing of said pair downwardly into anchoring contact with its own terminal contact at the exterior of the housing wall, and bracket means for supporting said transformer core and said unitary ceramic molding on said base plate.

2. Apparatus as in claim 1 in which said primary coil means extends partially along only one of the U-legs of the core.

3. In a burner system having a combustion chamber, means for providing ignitable fuel and high voltage ignition electrodes in the chamber, the improvement comprising a high voltage unpotted discontinuous duty cycle ignition transformer having a core of U-I configuration and a pair of side-by-side secondary coils between the ends of the core and each of which is wrapped around its associated one of the U-legs, with its terminal wire leading from an axially and transversely central terminal point at its bottom side, primary coil means also wrapped around its own length portion of one of the U-legs, each end of the core being free of coils, combined mounting and high voltage tap means comprising a bracket understraddling the coils and fixed to and supporting each end of the core and itself having a base face for supported contact with a windowed mounting plate, high voltage bushing means comprising a pair of insulator bushings extending from below said base face directly upwardly through a base face opening and into apposition with said terminal points, said terminal wires each being drawn through the center of its own insulator bushing of said pair downwardly into anchoring contact with its own terminal contact at the bottom end of its associated insulator bushing, detent means on said insulator bushing means engaging the underside of the bracket at the periphery of the base face opening, tie-down means within the bracket for holding said detent means in said engagement and thereby fastening the insulator bushing means to the bracket, said combined mounting and high voltage tap means and said transformer together providing a unitary non-potted assembly mountable as a unit on a windowed mounting base with the high voltage terminal contacts projecting below the window of the base for contact with electrodes to be powered by the transformer.

4. A device as in claim 3, the pair of insulating bushings being joined together side-by-side as a single molding, said detent means comprising flange means on the molding, said tie-down means comprising a peg extending through the molding and through at least one side of the bracket.

5. A device as in claim 3, the primary coil means consisting of only one primary coil wrapped around one of the U-legs.

6. An electronics components package or assembly comprising a housing containing both a control system board and an unpotted ignition transformer, the housing having a base plate, the control system board extending from one end of the housing to an intermediate location, the transformer extending from the other end of the housing to said intermediate location, the control system board being spaced above the housing base plate for mounting of circuit elements or interconnections on the underside as well as on the topside of the board, the transformer having a core of U-I configuration, bracket means below the core and supporting the core on the base plate so that the core is spaced above the base plate a greater distance than is the control system board, coil means on the U-legs of the core but not on the ends thereof, one end of the core being at the end of the housing associated with the transformer and the other end of the core overlying the control system board at said intermediate location.

7. An electronics components package or assembly for an oil burner unit comprising ignition electrodes, a housing containing both a control system board and an unpotted ignition transformer, the housing having a base plate, the control system board extending from one end of the housing to an intermediate location, the transformer extending from the other end of the housing to said intermediate location, the control system board being spaced above the housing base plate for mounting of circuit elements or interconnections on the underside as well as on the topside of the board, the transformer having a core of U-I configuration and a pair of side-by-side secondary coils between the ends of the core and each of which is wrapped around its associated one of the U-legs, with its terminal wire leading from an axially and transversely central terminal point at its bottom side, only a single primary coil wrapped around its own length portion of only one of the U-legs to provide a bilaterally asymmetric coil arrangement, said control system board being connected to said transformer and including means for interrupting the operation of the transformer in intervals between ignitions of an associated oil burner, each end of the core being free of coils, combined mounting and high voltage tap means comprising a bracket understraddling the coils and fixed to and supporting each end of the core and itself having a base face for supported contact with said housing base plate and high voltage bushing means comprising a pair of insulator bushings joined together side-by-side as a single molding and extending from below said base face and said housing base plate directly upwardly through windows in said housing base plate and said base face and into apposition with said terminal points, said bracket supporting the core on the housing base plate so that the core is spaced above the base plate a greater distance than is the control system board, one end of the core being at the end of the housing associated with the transformer and the other end of the core overlying the control system board at said intermediate location, said terminal wires each being drawn through the center of its own insulator bushing of said pair downwardly into anchoring contact with its own terminal contact at the bottom end of its associated insulator bushing, detent means on said insulator bushing means and engaging the underside of the bracket at the periphery of the window in the base face, tie-down means within the bracket for holding said detent means in said engagement and thereby fastening the insulator bushing means to the bracket, said combined mounting and high voltage tap means and said transformer together providing a unitary non-potted assembly mountable as a unit on the windowed base plate with the high voltage terminal contacts projecting below the window of the base plate for electrical contact with said electrodes and operation of the electrodes by the transformer.

8. A device as in claim 7, said tie-down means comprising a peg extending through said molding and through at least one side of said bracket.

* * * * *